United States Patent [19]

Arend, Jr.

[11] 3,959,112

[45] May 25, 1976

[54] DEVICE FOR PROVIDING UNIFORM AIR DISTRIBUTION IN AIR-AGITATED ELECTROWINNING CELLS

[75] Inventor: Carl A. Arend, Jr., Armonk, N.Y.

[73] Assignee: Amax Inc., Greenwich, Conn.

[22] Filed: June 12, 1975

[21] Appl. No.: 586,233

[52] U.S. Cl. ..... 204/273; 204/108; 204/277

[51] Int. Cl.[2] ..... C25C 1/12; C25C 7/00

[58] Field of Search ..... 204/106, 107, 108, 273, 204/277, 149

[56] References Cited

UNITED STATES PATENTS

| | | | |
|---|---|---|---|
| 1,442,977 | 1/1923 | Schwuchon et al. | 204/277 |
| 1,600,730 | 9/1926 | Haffner | 204/277 X |
| 3,259,049 | 7/1966 | Uithoven | 204/277 X |
| 3,262,870 | 7/1966 | Harlan | 204/108 |
| 3,839,180 | 10/1974 | Takaysu | 204/273 X |

*Primary Examiner*—John H. Mack
*Assistant Examiner*—A. C. Prescott
*Attorney, Agent, or Firm*—Kasper T. Serijan; Eugene J. Kalil

[57] ABSTRACT

A pair of tubular air-sparging elements is provided cooperatively associated with a cathode, each of said tubular elements being disposed at opposite faces of the cathode at the bottom of said cathode and running the entire length of said bottom, each of the air-sparging elements comprising an inner tube disposed within an outer foraminous sleeve of larger diameter, said inner tube having a plurality of air emitting orifices disposed along the length thereof, such that air passing through said inner tube as coarse bubbles emerges as fine bubbles through the foraminous sleeve to form a uniform curtain of air bubbles along the plating faces of said cathode which inhibits the formation of rough surface deposits.

6 Claims, 5 Drawing Figures

DEVICE FOR PROVIDING UNIFORM AIR DISTRIBUTION IN AIR-AGITATED ELECTROWINNING CELLS

This invention relates to a device for providing uniform air distribution in air-agitated electroplating tanks or cells, such as electrowinning cells.

STATE OF THE ART

It is known to use electrolytic processes to purify partially refined copper (e.g. blister copper) or to electrowin copper from acid-bearing leach solutions. For example, in the electrolytic refining process, an impure copper anode is dissolved anodically in the electrolyte while high purity copper is deposited out of solution at the cathode.

However, in recovering copper from leach solutions by electrowinning, an insoluble anode is used (e.g. lead, lead-antimony alloy, or the like) immersed in the electrolyte and the copper in the electrolyte deposited out at the cathode by passing a current from the anode through the solution to the anode. Thus, the solution is depleted of copper and fresh copper-rich electrolyte is introduced to replace the deposited copper.

Generally speaking, in refining impure copper anodes, a starting sheet of high purity copper is employed for the cathode and, upon completion of the plating cycle, the whole cathode with the deposited copper is removed and usually melted and cast into wire bars. Alternatively, starting cathode sheets of titanium may be used from which the attached copper is easily removed by high pressure steam since titanium is self-passivating in the electrolyte and forms a very thin oxide coating to which the copper deposit does not adhere too strongly.

In the electrowinning of copper from copper sulfate leach solutions, the starting cathode sheets may be either copper or titanium.

In order to obtain good production rates, it is preferred to plate out the copper at as high a current density as possible in the range of about 15 to 30 amps/sq.ft. and at temperatures ranging from 40°C to 70°C. As the current density approaches the higher range, the deposited copper tends to have a roughened surface and trees are apt to form which can cause a short in the bath, especially where the cathode is only a few inches from the anode.

One method for inhibiting the formation of a rough surface is to provide a rising curtain of small air bubbles from the bottom of the cathode to the top by using a pair of air-sparging tubes, with each of the pairs arranged along opposite sides of the bottom end of the cathode and extending to the full length of the bottom end, the sparging tubes having orifices spaced along the length thereof through which air is bubbled to form a rising curtain adjacent the plating faces of the cathode. However, the orifices which were necessarily small, tended to plug up during use, such that it was difficult to maintain a uniform air bubble curtain and thus, surface roughness could not be avoided at all parts of the cathode.

I have now found that I can overcome the foregoing problem by employing a sparger tube element comprising an inner tube with orifices disposed along the length thereof fitted within a foraminous sleeve of larger diameter, such as a weave or screen of substantially inert material, e.g. corrosion resistant metal filaments or woven fabric, the orifices of the inner tube being of substantially larger size than the average opening or mesh size of the foraminous sleeve.

OBJECT OF THE INVENTION

It is thus an object of the invention to provide a device for inhibiting surface roughness formation on a cathode by providing a uniform curtain of rising air bubbles adjacent the plating faces of a cathode.

Another object is to provide an air-sparging device comprising a tube having orifices along the length thereof inserted within a foraminous sleeve of larger diameter.

These and other objects will more clearly appear when taken in conjunction with the following disclosure, the claims and the accompanying drawing, wherein:

STATEMENT OF THE INVENTION

Figure 1:
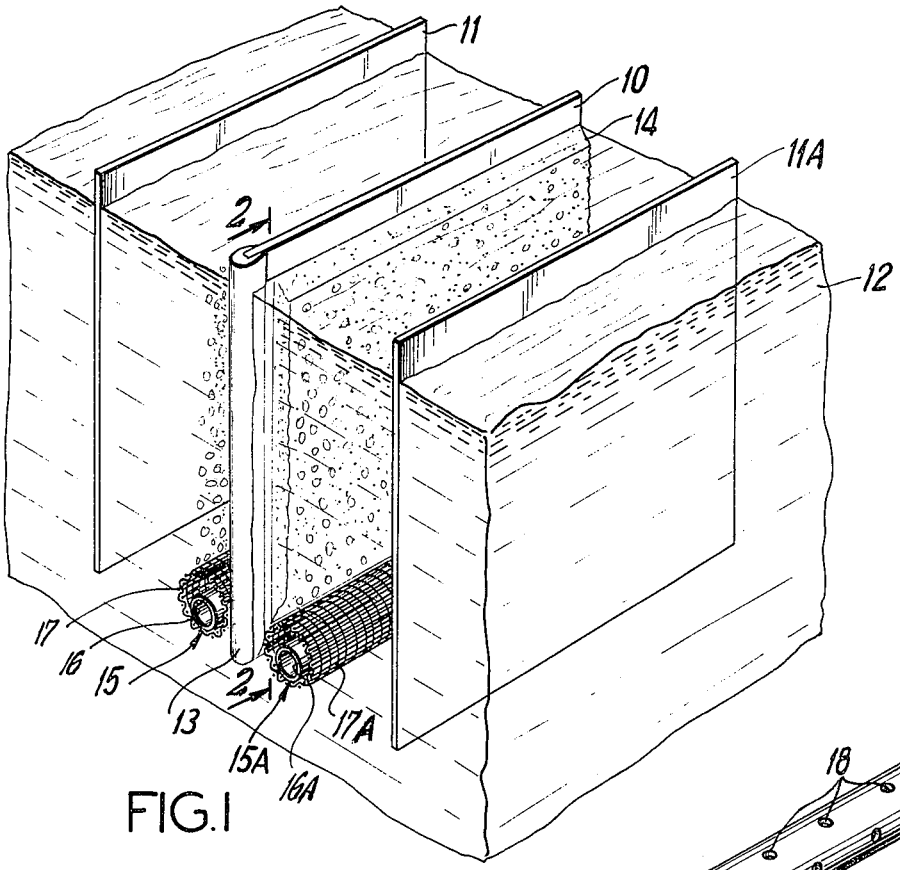
FIG. 1 shows a portion of a plating system in three dimension illustrating the use of the device provided by the invention.
Figure 3:
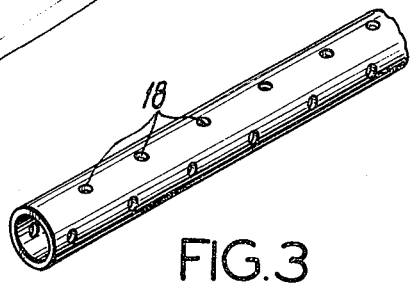
FIG. 3 depicts a tubular element employed in the construction of the device provided by the invention.

The present invention is directed to an electrolytic refining system in which refined copper is deposited onto a plurality of cathodes extending downwardly into a copper electrolyte and in which a uniform curtain of air bubbles is employed adjacent the plating faces of the cathode to inhibit the formation of a rough deposit. The cathodes extend into the electrolyte short of the bottom of the electrolytic tank, each cathode having cooperatively associated with the bottom end thereof a pair of tubular air-sparging elements, each element of the pair being disposed at opposite faces of the cathode along the bottom end thereof and running the entire length of said bottom, each of the air-sparging elements comprising an inner tube disposed within an outer foraminous sleeve of larger diameter formed of a tight weave of corrosion resistant metal filaments or inert synthetic organic fibers, said inner tube having a plurality of air-emitting orifices disposed along the length of said tube.

The size of the orifices on said tube may be fairly large and may have an average size or width such that there is very little or substantially no pressure drop as the air passes through said orifices into the space confined by the sleeve. The orifices should not be so large as to impair the strength of the tube which is used as a support for the sleeve. Thus, the orifices may be circular in which case the width of the orifice would be its diameter; or the orifice may be in the form of slits.

The foraminous sleeve of woven material has a sufficiently tight weave such that there is a substantial pressure drop across the thickness of the sleeve as air passes therethrough. The outer sleeve may be in the form of a sock, such as a filter, the spaces in the weave being such as to insure uniform distribution of air across the face of the cathode at the air flow rates used. A relatively tight weave is used to insure good distribution of air passing through the porous sleeve at low air rates through the inner tube. Any synthetic organic fiber inert to the aqueous electrolyte may be employed as the woven sleeve, such as polypropylene, polyethylene, polyester (Dacron), nylon and the like. The weave is preferably of the interlocking type to minimize the possibility of the threads in one direction slipping on the threads in the other direction.

The types of cloth which are preferred include twilled weaves or knits (which do not have warp or filling threads). Multifilament cloths are preferred and should be calendered.

The desired permeability of the cloth (foraminous sleeve) is that which is measured on the dry basis under standard conditions and which is used as a guide as to the relative tightness of the weave. The air permeability of the foraminous sleeve generally corresponds to about 2 to 30 SCFM/ft$^2$ of surface measured dry at a pressure differential of about one-half inch water for material having a density of less than 10 oz/sq. yard.

While a metallic weave of corrosion resistant metal may be used, cloths made of inert synthetic fibers are preferred. A cloth sleeve is easy to work with in that, if a slight plugging of the pores thereof occurs due to crystallization of the electrolyte salt, the pores can be easily cleaned by shutting off the air flow and restarting it two or three times, which flexes the sleeve and cleans the cloth by dislodging the crystals and working unsaturated solution through the foraminous structure of the cloth to redissolve the fine crystals.

The foregoing feature provides cost savings in that it avoids the use of rigid sparger elements which require the drilling of large numbers of very small, accurately spaced holes. Thus, the invention provides marked advantages over conventional practice.

The material for the inner tube is not as important so long as it is corrosion resistant. Thus, stainless steel or other corrosion resistant metal or hard plastic tubing, e.g. fiberglass reinforced polyester of other plastic, can be used which does not soften below 80°C.

Thus, by using an inner tube with fairly large size orifices, plugging within the tube is avoided. Moreover, by surrounding the tube with a foraminous sleeve, such as a filter sock, a substantially uniform air curtain of fine air bubbles is produced adjacent the plating faces of the cathode.

DETAIL ASPECTS OF THE INVENTION

The preferred embodiments of the invention will be apparent by referring to FIGS. 1 to 5 of the drawing.

In FIG. 1, a fragment of an electrowinning copper plating system is shown comprising at least one cathode 10 supported by means not shown between a pair of insoluble anodes 11, 11A. In this instance, the insoluble anode is a lead-antimony anode.

The anode-cathode system is immersed in a copper sulfate electrolyte 12 shown, the confining electrolytic tank being removed for purposes of clarity. The cathode in the embodiment of FIG. 1 is made of titanium, the bottom and side edges having an insulating edging 13, e.g. of plastic, applied thereto to prevent copper from locking onto the cathode sheet at the edges.

The cathode has a built up layer 14 of copper on both sides thereof. Adjacent the bottom end of the cathode is disposed a pair of air-sparging elements 15, 15A comprising inner tubes 16, 16A located within foraminous sleeve 17, 17A, respectively. The inner tube shown in FIG. 3 has a plurality of orifices 18 located along the length thereof.

Figure 2:
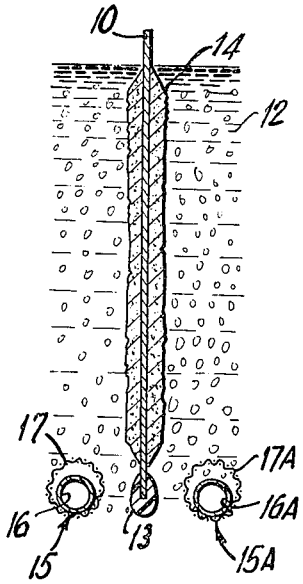
FIG. 2 is a cross section of FIG. 1 taken along line 2—2 showing a cathode using titanium as a starting sheet.
Figure 4:
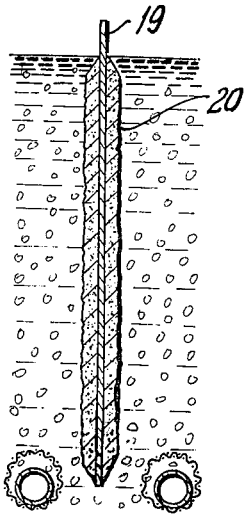
FIG. 4 is a cross section of another type cathode using pure thin copper sheet as a starting cathode.

As air is passed through the inner tube, and through the orifices with substantially little or no pressure drop, the air collects within the foraminous sleeve and passes therethrough at a substantial pressure drop as fine bubbles to provide a curtain or air bubbles which rise up along the plating faces of the cathode as shown in FIG. 1 and also in FIGS. 2 and 4. The sleeve provides a much more uniform distribution of air bubbles and assures a final cathode product of improved surface smoothness.

Figure 5:
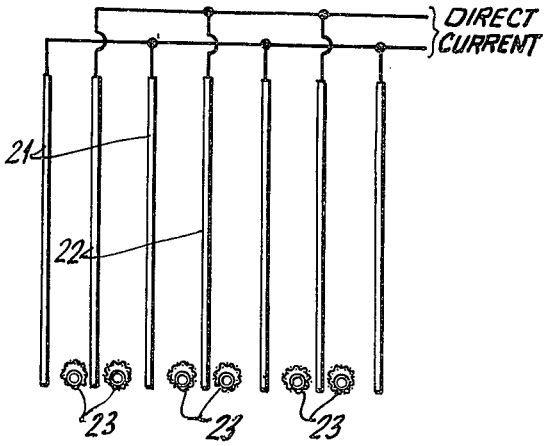
FIG. 5 is schematic of a series of anodes and cathodes arranged in parallel in a typical copper electrowinning system.

An arrangement of a plurality of anodes and cathodes is shown schematically in FIG. 5 comprising anodes 21 connected in parallel and a plurality of parallel connected cathodes, each having a pair of sparging elements 23 cooperatively associated therewith as shown.

When using titanium cathode sheets, the copper plating can be easily removed using steam jets. This is because the titanium starting sheet tends to passivate in solution by the formation of a thin oxide coating to which the copper only lightly adheres and from which the copper can be easily removed.

As stated earlier, copper starting sheets can also be employed. Thus, in FIG. 4, a copper plated cathode is shown comprising a copper starting sheet 19 containing a copper plating 20 obtained by electrowinning from a copper leach electrolyte. As will be noted, the device of the invention is similarly used to inhibit the formation of a rough surface at substantially high current densities (e.g. 15 to 30 amps/sq.ft. at 40°C to 70°C).

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. In an electrolytic refining system wherein refined metal is deposited onto a plurality of cathodes extending downwardly into an electrolyte with the bottom of each cathode terminating short of the bottom of a tank in which the electrolyte is confined, an improved device for inhibiting surface roughness formation of said deposited metal comprising:

a pair of tubular air-sparging elements cooperatively associated with each cathode, each element of said pair of tubular elements being disposed at opposite faces of the cathode at the bottom of said each cathode and running substantially the entire length of said bottom, each of said air-sparging elements comprising a rigid inner tube of substantially inert material disposed within an outer foraminous sleeve of inert material and of larger diameter, said inner tube having a plurality of air-emitting orifices disposed along said tube through which air is emitted at substantially no pressure drop, the foraminous sleeve being characterized by a permeability such that air passes therethrough at a substantial pressure drop.

2. The improved device of claim 1, wherein said foraminous sleeve is a weave of synthetic fibers, the weave being characterized by a permeability to air corresponding to about 2 to 30 SCFM/ft$^2$ of surface determined on the dry basis at a pressure differential of about one-half inch water.

3. The improved device of claim 2, wherein the foraminous woven sleeve is selected from the group consisting of polypropylene, polyethylene and polyester.

4. The improved device of claim 2, wherein the rigid inner tube is made of a material selected from the group consisting of corrosion-resistant metal and rigid substantially inert plastic.

5. In an electrolytic refining system wherein refined copper is deposited onto a plurality of cathodes extending downwardly into a copper electrolyte with the bottom of each cathode terminating short of the bottom of a tank in which the electrolyte is confined, an improved device for inhibiting surface roughness formation of said deposited copper comprising, a pair of tubular air-sparging elements cooperatively associated with each cathode, each of said tubular elements being disposed at opposite faces of the cathode at the bottom of said each cathode and running the entire length of said bottom, each of said air-sparging elements comprising a rigid inner tube made of a material selected from the group consisting of corrosion-resistant metal and a substantially inert plastic disposed within an outer foraminous sleeve of larger diameter made of woven synthetic fiber selected from the group consisting of polypropylene, polyester and polyethylene, said inner tube having a plurality of air-emitting orifices disposed along said tube through which air is emitted at substantially no pressure drop, the foraminous sleeve being characterized by a permeability such that air passes therethrough at a substantial pressure drop.

6. The improved device of claim 5, wherein the permeability of said foraminous sleeve to air corresponds to about 2 to 30 SCFM/ft$^2$ of surface determined on the dry basis at a pressure differential of about one-half inch water.

* * * * *